United States Patent [19]

Ludwigsen et al.

[11] Patent Number: 4,509,344

[45] Date of Patent: Apr. 9, 1985

[54] APPARATUS AND METHOD OF COOLING USING STORED ICE SLURRY

[75] Inventors: John S. Ludwigsen; Jill L. Ludwigsen, both of Naperville; Terry A. Gallagher, Wheaton, all of Ill.

[73] Assignee: Chicago Bridge & Iron Company, Oak Brook, Ill.

[21] Appl. No.: 559,486

[22] Filed: Dec. 8, 1983

[51] Int. Cl.[3] ..... F25C 1/24

[52] U.S. Cl. ..... 62/76; 62/123; 62/330; 62/434; 62/541; 165/104.17

[58] Field of Search ..... 62/48, 123, 434, 532, 62/541, 76, 330; 165/104.15, 104.17

[56] References Cited

U.S. PATENT DOCUMENTS

| | | | |
|---|---|---|---|
| 3,835,658 | 9/1974 | Wilson | 62/123 |
| 3,885,399 | 5/1975 | Campbell | 62/123 |
| 3,992,900 | 11/1976 | Campbell | 62/123 |
| 4,186,562 | 2/1980 | Tyree, Jr. | 62/48 |
| 4,211,085 | 7/1980 | Tyree, Jr. | 62/48 |
| 4,224,801 | 9/1980 | Tyree, Jr. | 62/48 |
| 4,286,436 | 9/1981 | Engdahl et al. | 62/123 |
| 4,335,581 | 7/1982 | Nail | 62/123 |
| 4,341,085 | 7/1982 | Nail | 62/541 |
| 4,438,634 | 3/1984 | Merle et al. | 62/123 |
| 4,442,679 | 4/1984 | Stafford et al. | 62/123 |

*Primary Examiner*—Ronald C. Capossela

*Attorney, Agent, or Firm*—Marshall, O'Toole, Gerstein, Murray & Bicknell

[57] ABSTRACT

Apparatus comprising a freeze exchanger having an aqueous liquid feed stream inlet and an aqueous liquid stream outlet; a closed loop refrigeration system for supplying a refrigerant to the freeze exchanger for indirectly cooling aqueous liquid fed thereto; an ice storage tank; a conduit for withdrawing aqueous liquid, or a mixture of ice and aqueous liquid, from the freeze exchanger outlet and delivering it to the ice storage tank; a conduit for removing cold aqueous liquid from the ice storage tank and feeding it to a heat exchanger to cool fluid used for cooling purposes; and a conduit for removing warm aqueous liquid from the heat exchanger and feeding it to the ice storage tank, or to the freeze exchanger, or partially to both.

A method of cooling making use of the apparatus is also disclosed.

36 Claims, 2 Drawing Figures

APPARATUS AND METHOD OF COOLING USING STORED ICE SLURRY

This invention relates to apparatus for, and methods of, cooling. More particularly, this invention is concerned with novel apparatus and methods of cooling which include the storage of cooling capacity or thermal energy in the form of an ice slurry or slush and the subsequent use of the ice for any cooling purpose, including air conditioning and industrial installations which require cooling or refrigeration.

BACKGROUND OF THE INVENTION

Cooling and refrigeration requirements of industrial installations, as well as the central air conditioning of commercial buildings and industrial plants, requires large amounts of electrical energy to operate the refrigeration plants needed for these purposes. This places a high demand on electric utilities during on-peak periods, which usually are from about 9 A.M. to 10 P.M. Monday through Friday. Utilities must provide enough generating capacity to meet this demand. This requires a very high capital investment for plants and equipment which are fully utilized only in hot weather in daylight hours. Evenings and weekends are off-peak demand periods and much less of the total generating capacity is used then. In addition, less generating capacity is used on cool days in the spring and fall periods of the year in the United States.

To encourage a better or more uniform demand for electric power, many utilities charge a reduced rate for electricity used during off-peak periods. Business and industry have accordingly been looking for ways to shift or transfer as much as possible of their electrical consumption to off-peak periods to take advantage of the reduced rates and also to minimize future electric rate increases by making additional electric generating plants unnecessary, or at least delaying generating plant expansion.

It has been recognized for some time that a substantial potential savings could be realized if much of the refrigeration or air conditioning load could be moved from on-peak to off-peak periods. To do this, it has been proposed to operate refrigeration plants during off-peak periods to produce cold or chilled water or ice for storage. During on-peak periods the cold or chilled water or ice would then be used to provide cooling. Because ice provides greater cooling capacity per unit volume than chilled water (a ratio of about 7:1) much commercial interest has been directed toward providing so-called ice building equipment for this purpose.

At this time it appears that the type of ice builder of greatest interest, and one which has been put into use in a number of installations, constitutes a tank, for holding water, through which a large number of small pipes run in one of several different patterns or arrangements. A liquid refrigerant is fed through the small pipes. As the refrigerant absorbs heat from the water, a layer of ice about 1 to 3 inches thick forms on each pipe. Ice is produced in this manner during off-peak periods.

When it becomes desirable to utilize the cooling potential stored in the ice for air conditioning or other purposes, a stream of water is fed through the tank to cool the water by exchange of heat to the ice. The cooled water is withdrawn from the tank and fed to a heat exchanger to cool or air condition a building or for other cooling purposes. The resulting warm water is then returned to the tank to be cooled again by contact with the ice. This system can continue to provide cooling until all the ice is melted.

Ice builders of the described type are costly to fabricate and operate. The pipes are not readily repaired or serviced. In addition, as the ice layer on the pipes increases in thickness, heat exchange between the water and refrigerant decreases because of the insulating effect which the ice provides. Furthermore, a very large heat exchange surface must be provided by the pipes to obtain the cooling needed to produce the desired quantity of ice.

From the above it is clear that a need exists for alternative apparatus and methods for cooling which can operate with nearly constant efficiency during off-peak load, or even during on-peak load if desired.

SUMMARY OF THE INVENTION

According to one aspect of the invention, there is provided a method comprising removing aqueous liquid from an ice storage tank and feeding the aqueous liquid through a freeze exchanger in indirect heat exchange with a refrigerant to convert at least part of the aqueous liquid to ice; feeding an aqueous liquid-ice mixture from the freeze exchanger to the ice storage tank to provide an ice slurry and aqueous liquid therein; and removing cold aqueous liquid from the ice storage tank and feeding it through a heat exchanger in indirect heat exchange with a fluid to be cooled and used for cooling purposes, and then returning the now warm aqueous liquid exiting from the heat exchanger to the ice storage tank to be cooled by contact with the ice therein.

When desirable, the aqueous liquid removed from the ice storage tank can be recycled to the freeze exchanger to produce more ice.

The freeze exchanger used in the method can be a shell and tube freeze exchanger with vertical tubes in which the aqueous liquid is cooled and ice produced by downward flow of the aqueous liquid in the tubes. The ice produced in such a freeze exchanger is in the form of small crystals which readily flow with the aqueous liquid.

More particularly, the freeze exchanger used can be a falling film vertical shell and tube freeze exchanger in which the aqueous liquid is cooled and ice produced by downward flow of a film of the aqueous liquid in the tubes. One suitable freeze exchanger is disclosed in U.S. Pat. No. 4,335,581.

In practicing the method, the aqueous liquid supplied to the freeze exchanger, the ice storage tank and the heat exchanger desirably is in direct contact or in intercommunication with itself as a common body of aqueous liquid.

It is sometimes desirable in practicing the method to feed the aqueous liquid-ice mixture from the freeze exchanger to a receiving tank and to then recycle the aqueous liquid-ice mixture from the receiving tank to the freeze exchanger to produce more ice. Ice slurry can be removed from the receiving tank and be fed to the ice storage tank. By placing the freeze exchanger on top of the ice storage tank, the tank can also function as the ice storage tank and as the receiving tank.

After the liquid-ice mixture is fed to the ice storage tank, an ice slurry forms as a layer on top of a lower layer of aqueous liquid. The aqueous liquid can be recycled from the ice storage tank to the freeze exchanger to produce more ice.

It is particularly desirable in practicing the invention to remove aqueous liquid from the ice storage tank and feed it through the freeze exchanger to convert at least part of the aqueous liquid to ice primarily when the refrigerant liquid is cooled by a refrigeration means having an electric powered compressor operated during off-peak electric usage.

The invention also provides the method of using the apparatus during peak load cooling periods by diverting part of the warm aqueous liquid, exiting from the heat exchanger, to the freeze exchanger to produce cold aqueous liquid and then feeding the cold aqueous liquid to the ice storage tank directly for additional cooling or to the heat exchanger. In this way, the apparatus can be used as a chiller.

According to a second aspect of the invention, there is provided apparatus comprising a freeze exchanger having an aqueous liquid feed stream inlet and an aqueous liquid stream outlet; a closed loop refrigeration means for supplying a refrigerant to the freeze exchanger for indirectly cooling aqueous liquid fed thereto; an ice storage tank; means for withdrawing a mixture of ice and aqueous liquid from the freeze exchanger outlet and delivering it to the ice storage tank; means for removing cold aqueous liquid from the ice storage tank and feeding it to a heat exchanger to cool fluid used for cooling purposes; and means for removing warm aqueous liquid from the heat exchanger and feeding it to the ice storage tank, or to the freeze exchanger, or partially to both.

The apparatus also desirably includes means for removing aqueous liquid from the ice storage tank for delivering it to the freeze exchanger.

More particularly, the invention provides apparatus comprising a freeze exchanger of the shell and tube type having an aqueous liquid feed stream inlet and an aqueous liquid stream outlet; a closed loop refrigeration means for supplying a refrigerant to the freeze exchanger for indirectly cooling aqueous liquid fed thereto; a receiving tank for receiving a mixture of ice and aqueous liquid from the freeze exchanger outlet; means for removing aqueous liquid from the receiving tank and feeding it to the freeze exchanger inlet; an ice storage tank; means for removing an ice slurry from the receiving tank and feeding it to the ice storage tank; means for removing cold aqueous liquid from the ice storage tank and feeding it to a heat exchanger to cool fluid used for cooling purposes; and means for removing warm aqueous liquid from the heat exchanger and feeding it to the ice storage tank, or to the freeze exchanger inlet, or partially to both.

The invention furthermore provides apparatus comprising a freeze exchanger of the shell and tube type having an aqueous liquid feed stream inlet and an aqueous liquid stream outlet; a closed loop refrigeration means for supplying a refrigerant to the shell side of the freeze exchanger; a receiving tank for receiving a mixture of ice and aqueous liquid from the freeze exchanger outlet; means for removing aqueous liquid from the receiving tank and feeding it to the freeze exchanger inlet; an ice storage tank adapted to have a layer of ice slurry floating on a layer of cold aqueous liquid in the bottom of the tank; means for removing an ice slurry from the receiving tank and feeding it to the ice storage tank; means for removing aqueous liquid from the ice storage tank and feeding it to the freeze exchanger inlet; means for removing cold aqueous liquid from the bottom of the ice storage tank and feeding it to a heat exchanger to cool a fluid used for cooling purposes; and means for removing warm aqueous liquid from the heat exchanger and feeding it to the ice storage tank, or the freeze exchanger inlet, or partially to both.

Any suitable refrigerant can be used in the apparatus and in practicing the method. The refrigerant can be a liquid at ambient temperature, such as cold ethanol or an aqueous glycol solution. The refrigerant can also be a gas at ambient temperature, such as ammonia or a FREON brand refrigerant.

A large number of aqueous liquids can be used in the apparatus and method, including brine (water plus sodium chloride, with or without other minerals), a mixture of water and a liquid glycol, specifically ethylene glycol, or other aqueous solutions. Brine is presently the liquid of choice since the ice formed when it is used has a desirable crystal size, flows well and permits brine to drain through it rapidly.

DETAILED DESCRIPTION OF THE DRAWINGS

To the extent it is reasonable and practical, the same or similar elements or parts which appear in the various views of the drawings will be identified by the same numbers.

Figure 1:
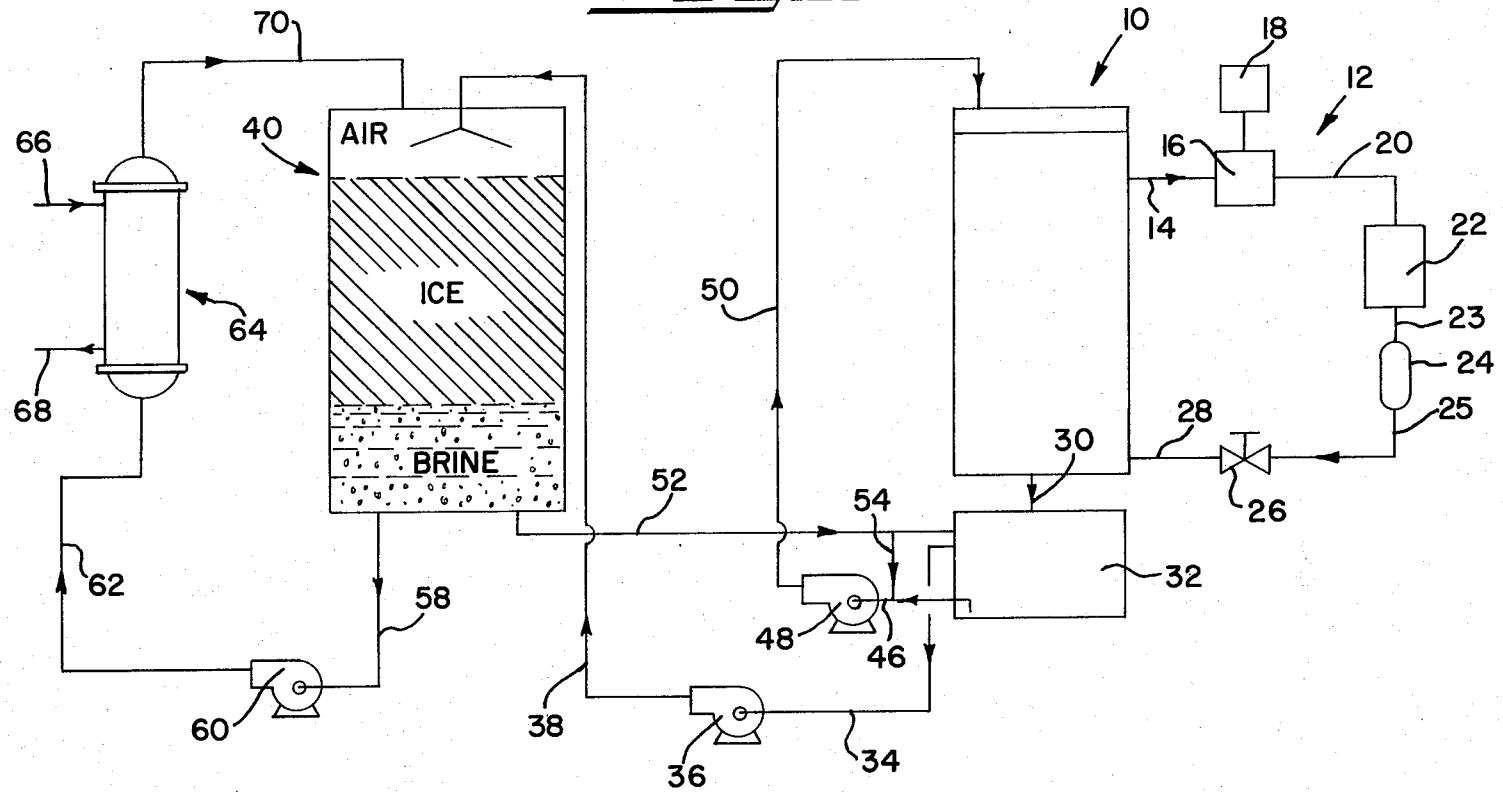
FIG. 1 is a schematic drawing illustrating a first embodiment of apparatus according to the invention.

With reference to FIG. 1, the freeze exchanger 10 is of the vertical shell and tube falling film type such as disclosed in U.S. Pat. No. 4,286,436. The shell side of the freeze exchanger 10 is cooled by means of a closed loop refrigeration system 12. Gaseous refrigerant, such as ammonia, is removed from the shell side of freeze exchanger 10 by conduit 14 and fed to compressor 16 driven by electric motor 18. The compressed refrigerant is fed from compressor 16 to conduit 20 which delivers it to condenser 22. The liquid refrigerant is removed from condenser 22 by conduit 23 and delivered to refrigerant receiver 24 and then by conduit 25 to expansion valve 26 through which it is expanded to conduit 28 for delivery to the shell side of freeze exchanger 10.

Brine is fed by conduit 50 to the top of freeze exchanger 10 and flows as a thin falling film down the inner surface of the tubes. As the brine flows downwardly in the tubes it is cooled and a portion of the water in the brine is converted to small ice crystals. The slurry mixture of brine and ice flows from freeze exchanger 10 through outlet 30 to receiver tank 32.

The slurry is collected in receiving tank 32 and is withdrawn therefrom by conduit 34 and fed to pump 36 which delivers it to conduit 38 to be fed through the top to ice storage tank 40. Brine in the lower part of receiving tank 32 is withdrawn by conduit 46 and fed to pump 48 which delivers it to conduit 50 for delivery to the top of freeze exchanger 10.

During ice building brine is removed from ice storage tank 40 by means of conduit 52 and is fed to receiving tank 32 to be recycled through freeze exchanger 10. Alternatively, the brine can be fed from conduit 52 to conduit 54 and then to conduit 46 which feeds it to pump 48 for recycling to the freeze exchanger 10 by means of conduit 50.

The described method of ice building can continue as long as desired, but generally will proceed until ice storage tank is about one-half to three-fourths full of ice with the balance liquid. For most economical ice building, the apparatus is operated for ice building when electricity rates are the lowest, i.e. at off-peak periods, which usually are from Sunday through Thursday evenings from about 10 P.M. to 9 A.M. the following morning, and weekends from 10 P.M. Friday to Sunday evening. Of course, off-peak periods will vary with location and ambient conditions.

When it is desired to utilize the cooling capacity stored in the form of ice for cooling purposes, cold brine can be withdrawn from ice storage tank 40 by conduit 58 and fed to pump 60. Pump 60 delivers the cold brine to conduit 62 which feeds it to heat exchanger 64 to indirectly cool a warm fluid fed thereto by conduit 66 and withdrawn through conduit 68 as cold fluid. This results in the brine becoming warm. The warm brine is withdrawn from heat exchanger 64 through conduit 70 and is fed into the top or upper portion of ice storage tank 40. As the warm brine flows through the ice it is cooled by transfer of heat to the ice, thereby causing the ice to melt. This system can continue to operate so long as ice is available in the ice storage tank. Desirably, the amount of ice in the tank available for cooling should be adequate for the intended cooling period.

The described ice building and cooling system can be used as the main cooling system for air conditioning a building, whether operated entirely or primarily during on-peak or off-peak electrical usage periods, or a combination thereof. The system also can be used to shift part of a present existing cooling load to off-peak periods by using it to supplement an existing conventional air conditioning system. Furthermore, the system can be used in air conditioning load leveling by using it in combination with a smaller conventional refrigeration system. Additionally, the system can be used in any industrial installation requiring cooling or refrigeration.

One advantage of the ice building apparatus of the invention is that it employs a freeze exchanger which facilitates ice making with less refrigerant evaporation surface area and better heat transfer than those using extensive pipes in a tank of water on which ice builds to a depth of about 1 to 3 inches. Another important feature of the apparatus of the invention is that it permits usage of the same liquid in common in the freeze exchanger, ice storage tank and heat exchanger.

Figure 2:
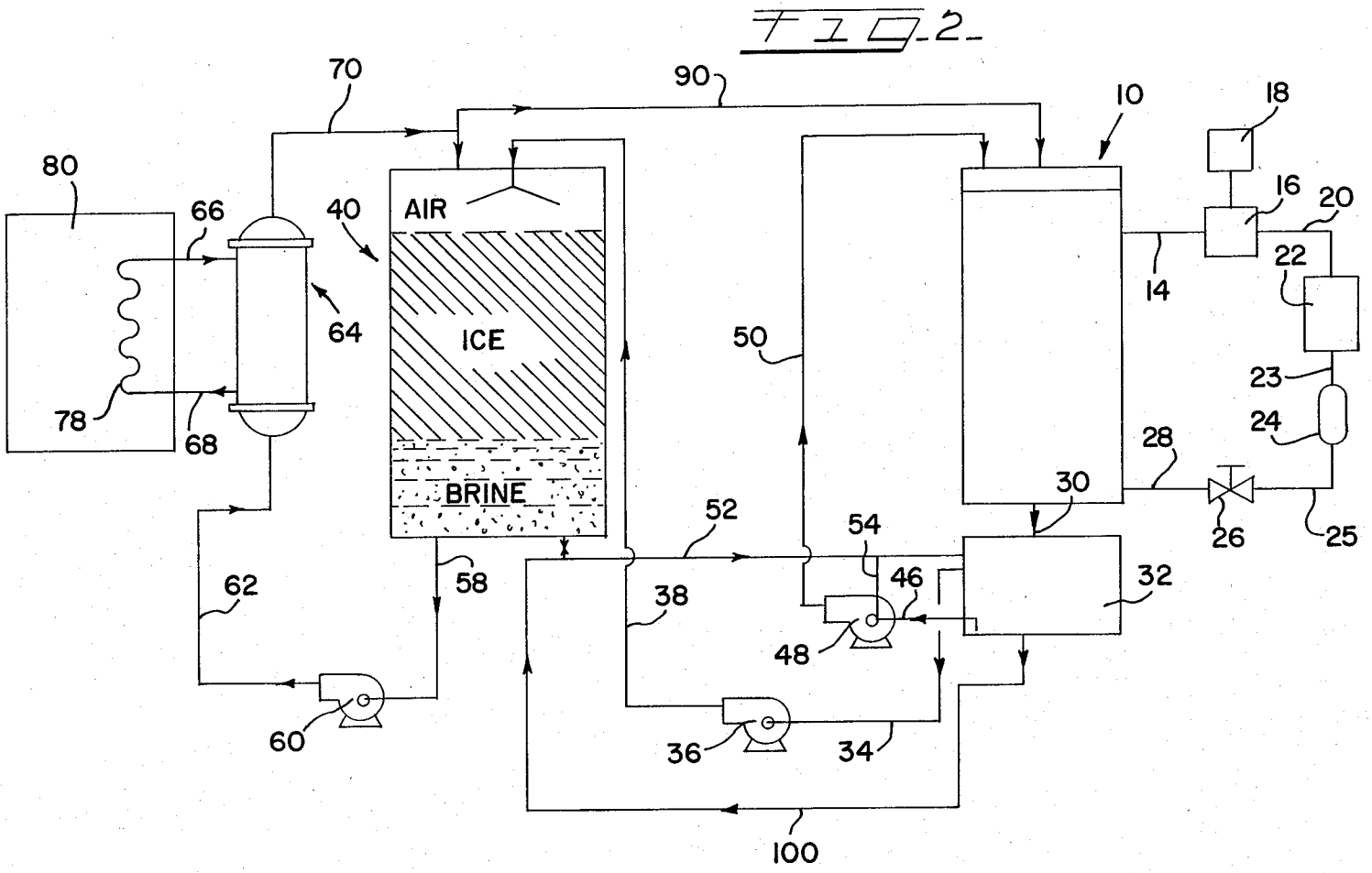
FIG. 2 is a schematic drawing illustrating a second embodiment of apparatus according to the invention.

FIG. 2 illustrates a second embodiment of apparatus according to the invention. In this embodiment the cold fluid withdrawn by conduit 68 from heat exchanger 64 is fed to coil 78 in facility 80 to provide the required cooling. The warm fluid is removed from coil 78 by conduit 66 and delivered to heat exchanger 64 to be recooled as previously described.

The ice storage tank 40, in the FIG. 2 embodiment, can be sized to store an amount of ice which is insufficient to provide the total cooling load of facility 80. However, the apparatus can still be used to provide the necessary cooling in the following manner. All or any portion of the warm brine in conduit 70 can be fed to conduit 90 and by it into the top of freeze exchanger 10. As the brine flows through the freeze exchanger, which is operating, it can be cooled without forming ice. The cold brine is removed from the freeze exchanger by conduit 30 and fed to receiving tank 32. Conduit 100 withdraws the cold brine from receiving tank 32 and feeds it to the bottom of ice storage tank 40. The cold brine can be withdrawn by conduit 58 from tank 40 and, by means of pump 60, delivered to conduit 62 which feeds it to heat exchanger 64 for use in cooling as previously described. Production of cold brine as described, and its use in cooling, can be during an on-peak electricity load period or, if desired, during an off-peak load period.

The foregoing detailed description has been given for clearness of understanding only, and no unnecessary limitations should be understood therefrom, as modifications will be obvious to those skilled in the art.

What is claimed is:

1. A method comprising:

removing aqueous liquid from an ice storage tank and feeding the aqueous liquid through a freeze exchanger in indirect heat exchange with a refrigerant to convert at least part of the aqueous liquid to ice;

feeding an aqueous liquid-ice mixture from the freeze exchanger to the ice storage tank to provide an ice slurry and aqueous liquid therein; and removing cold aqueous liquid from the ice storage tank and feeding it through a heat exchanger in indirect heat exchange with a fluid to be cooled and used for cooling purposes, and then returning the now warm aqueous liquid exiting from the heat exchanger to the ice storage tank to be cooled by contact with the ice therein.

2. A method according to claim 1 in which aqueous liquid is removed from the ice storage tank and recycled to the freeze exchanger to produce more ice.

3. A method according to claim 1 or 2 in which the freeze exchanger is a shell and tube freeze exchanger with vertical tubes and the aqueous liquid is cooled and ice produced by downward flow of the aqueous liquid in the tubes, and the ice is produced as small crystals.

4. A method according to claim 1 or 2 in which the freeze exchanger is a falling film shell and tube freeze exchanger and the aqueous liquid is cooled and ice produced by downward flow of a film of the aqueous liquid in the tubes, and the ice is produced as small crystals.

5. A method according to claim 1 in which the aqueous liquid supplied to the freeze exchanger, the ice storage tank and the heat exchanger is in direct contact or in communication with itself as a common body of aqueous liquid.

6. A method comprising:

removing aqueous liquid from an ice storage tank and feeding the aqueous liquid through a freeze exchanger in indirect heat exchange with a refrigerant to convert at least part of the aqueous liquid to ice;

feeding an aqueous liquid-ice mixture from the freeze exchanger to a receiving tank;

recycling aqueous liquid from the receiving tank to the freeze exchanger to produce more ice;

removing an aqueous liquid-ice slurry from the receiving tank and feeding it to the ice storage tank; and removing cold aqueous liquid from the ice storage tank and feeding it through a heat exchanger in indirect heat exchange with a fluid to be cooled and used for cooling purposes, and then returning the now warm aqueous liquid exiting from the heat exchanger to the ice storage tank to be cooled by contact with the ice therein.

7. A method according to claim 6 in which aqueous liquid is removed from the ice storage tank and recycled to the freeze exchanger to produce more ice.

8. A method according to claim 6 or 7 in which the freeze exchanger is a shell and tube freeze exchanger with vertical tubes and the aqueous liquid is cooled and ice produced by downward flow of the aqueous liquid in the tubes, and the ice is produced as small crystals.

9. A method according to claim 6 or 7 in which the freeze exchanger is a falling film shell and tube freeze exchanger and the aqueous liquid is cooled and ice produced by downward flow of a film of the aqueous liquid in the tubes, and the ice is produced as small crystals.

10. A method according to claim 6 in which the aqueous liquid supplied to the freeze exchanger, the ice storage tank and the heat exchanger is in direct contact or in communication with itself as a common body of aqueous liquid.

11. A method according to claim 1 or 6 in which the aqueous liquid is removed from the ice storage tank and fed through the freeze exchanger to convert at least part of the aqueous liquid to ice primarily when the refrigerant liquid is cooled by a refrigeration means having an electric powered compressor operating during off-peak electric usage; and during peak load cooling periods diverting part of the warm aqueous liquid, exiting from the heat exchanger, to the freeze exchanger to produce cold aqueous liquid and then feeding the cold aqueous liquid to the ice storage tank directly or to the heat exchanger.

12. A method comprising:

removing aqueous liquid from an ice storage tank and feeding the aqueous liquid through a freeze exchanger in indirect heat exchange with a refrigerant to convert at least part of the aqueous liquid to ice;

feeding an aqueous liquid-ice mixture from the freeze exchanger to the ice storage tank where it separates into an ice slurry and aqueous liquid;

recycling aqueous liquid from the ice storage tank to the freeze exchanger to produce more ice; and removing cold aqueous liquid from the ice storage tank and feeding it through a heat exchanger in indirect heat exchange with a fluid to be cooled and used for cooling purposes, and then returning the now warm aqueous liquid exiting from the heat exchanger to the freeze exchanger.

13. A method according to claim 12 in which aqueous liquid is removed from the ice storage tank and recycled to the freeze exchanger to produce more ice.

14. A method according to claim 12 or 13 in which the freeze exchanger is a shell and tube freeze exchanger with vertical tubes and the aqueous liquid is cooled and ice produced by downward flow of the aqueous liquid in the tubes, and the ice is produced as small crystals.

15. A method according to claim 12 or 13 in which the freeze exchanger is a falling film shell and tube freeze exchanger and the aqueous liquid is cooled and ice produced by downward flow of a film of the aqueous liquid in the tubes, and the ice is produced as small crystals.

16. A method according to claim 12 in which the aqueous liquid supplied to the freeze exchanger, the ice storage tank and the heat exchanger is in direct contact or communication with itself as a common body of aqueous liquid.

17. A method comprising:

removing aqueous liquid from an ice storage tank and feeding the aqueous liquid through a freeze exchanger in indirect heat exchange with a refrigerant to convert at least part of the aqueous liquid to ice;

feeding the aqueous liquid-ice mixture to a receiving tank;

recycling the aqueous liquid-ice mixture from the receiving tank to the freeze exchanger to produce more ice;

removing the ice slurry from the receiving tank and feeding it to the ice storage tank; and removing cold aqueous liquid from the ice storage tank and feeding it through a heat exchanger in indirect heat exchange with a fluid to be cooled and used for cooling purposes, and then returning the now warm aqueous liquid exiting from the heat exchanger to the freeze exchanger.

18. A method according to claim 17 in which aqueous liquid is removed from the ice storage tank and recycled to the freeze exchanger to produce ice or cold aqueous liquid.

19. A method according to claim 17 or 18 in which the freeze exchanger is a shell and tube freeze exchanger with vertical tubes and the aqueous liquid is cooled and ice produced by downward flow of the aqueous liquid in the tubes, and the ice is produced as small crystals.

20. A method according to claim 17 or 18 in which the freeze exchanger is a falling film shell and tube freeze exchanger and the aqueous liquid is cooled and ice produced by downward flow of a film of the aqueous liquid in the tubes, and the ice is produced as small crystals.

21. A method according to claim 17 in which the aqueous liquid supplied to the freeze exchanger, the ice storage tank and the heat exchanger is in direct contact with itself as a common body of aqueous liquid.

22. A method according to claim 1, 6, 12 or 17 in which the aqueous liquid is removed from the ice storage tank and fed through the freeze exchanger to convert at least part of the aqueous liquid to ice primarily when the refrigerant liquid is cooled by a refrigeration means using an electric powered compressor during off-peak electric usage.

23. A method of air conditioning with cooling, comprising:

removing aqueous liquid from the bottom of an ice storage tank and feeding the aqueous liquid through a freeze exchanger in indirect heat exchange with a refrigerant which is cooled by a refrigeration means having an electric powered compressor operating during off-peak electric usage, to convert at least part of the aqueous liquid to ice;

feeding the aqueous liquid-ice mixture to a receiving tank;

recycling the aqueous liquid to the freeze exchanger to produce more ice;

removing the ice slurry from the receiving tank and feeding it to an ice storage tank in which the ice floats on a lower layer of cold aqueous liquid;

during air conditioning periods, removing cold aqueous liquid from the ice storage tank and feeding it through a heat exchanger in indirect heat exchange with a fluid used to cool and air condition a building interior space, and then returning the now warm aqueous liquid exiting from the heat exchanger to the top of the ice storage tank to be cooled by flowing downwardly through the ice therein; and during peak load air conditioning periods diverting part of the warm aqueous liquid, exiting from the heat exchanger, to the freeze exchanger to produce cold aqueous liquid and then feeding the cold aqueous liquid to the ice storage tank directly or to the heat exchanger.

24. A method according to claim 23 in which aqueous liquid is removed from the ice storage tank and recycled to the freeze exchanger to produce more ice.

25. A method according to claim 23 or 24 in which the freeze exchanger is a shell and tube freeze exchanger with vertical tubes and the aqueous liquid is cooled and ice produced by downward flow of the aqueous liquid in the tubes, and the ice is produced as small crystals.

26. A method according to claim 23 or 24 in which the freeze exchanger is a falling film shell and tube freeze exchanger and the aqueous liquid is cooled and ice produced by downward flow of a film of the aqueous liquid in the tubes, and the ice is produced as small crystals.

27. A method according to claim 23 in which the aqueous liquid supplied to the freeze exchanger, the ice storage tank and the heat exchanger is in direct contact with itself as a common body of aqueous liquid.

28. Apparatus comprising:

a freeze exchanger having an aqueous liquid feed stream inlet and an aqueous liquid stream outlet;

a closed loop refrigeration means for supplying a refrigerant to the freeze exchanger for indirectly cooling aqueous liquid fed thereto;

an ice storage tank;

means for withdrawing aqueous liquid, or a mixture of ice and aqueous liquid, from the freeze exchanger outlet and delivering it to the ice storage tank;

means for removing cold aqueous liquid from the ice storage tank and feeding it to a heat exchanger to cool fluid used for cooling purposes; and means for removing warm aqueous liquid from the heat exchanger and feeding it to the ice storage tank, or to the freeze exchanger, or partially to both.

29. Apparatus according to claim 28 in which the freeze exchanger is a shell and tube freeze exchanger with vertical tubes cooled by the refrigerant on the shell side.

30. Apparatus according to claim 28 in which the ice is produced as small crystals and the ice in the storage tank is a slush or slurry.

31. Apparatus comprising:

a freeze exchanger of the shell and tube type having an aqueous liquid feed stream inlet and an aqueous liquid stream outlet;

a closed loop refrigeration means for supplying a refrigerant to the freeze exchanger for indirectly cooling aqueous liquid fed thereto;

a receiving tank for receiving aqueous liquid or a mixture of ice and aqueous liquid from the freeze exchanger outlet;

means for removing aqueous liquid from the receiving tank and feeding it to the freeze exchanger inlet;

an ice storage tank;

means for removing an ice slurry from the receiving tank and feeding it to the ice storage tank;

means for removing cold aqueous liquid from the ice storage tank and feeding it to a heat exchanger to cool fluid used for cooling purposes; and means for removing warm aqueous liquid from the heat exchanger and feeding it to the ice storage tank, or to the freeze exchanger inlet, or partially to both.

32. Apparatus according to claim 28 including means for removing aqueous liquid from the ice storage tank and feeding it to the freeze exchanger.

33. Apparatus according to claim 31 in which the freeze exchanger is a shell and tube freeze exchanger with vertical tubes cooled by the refrigerant on the shell side.

34. Apparatus according to claim 31 in which the ice is produced as small crystals and the ice in the ice storage tank is a slush or slurry.

35. Apparatus comprising:

a freeze exchanger of the shell and tube type having an aqueous liquid feed stream inlet and an aqueous liquid stream outlet;

a closed loop refrigeration means for supplying a refrigerant to the shell side of the freeze exchanger;

a receiving tank for receiving a mixture of ice and aqueous liquid from the freeze exchanger outlet;

means for removing aqueous liquid from the receiving tank and feeding it to the freeze exchanger inlet;

an ice storage tank adapted to have a layer of ice floating on a layer of cold aqueous liquid in the bottom of the tank;

means for removing an ice slurry from the receiving tank and feeding it to the ice storage tank;

means for removing aqueous liquid from the ice storage tank and feeding it to the freeze exchanger inlet;

means for removing cold aqueous liquid from the bottom of the ice storage tank and feeding it to a heat exchanger to cool fluid used for air conditioning a building;

means for removing warm aqueous liquid from the heat exchanger and feeding it to the ice storage tank, or the freeze exchanger inlet, or partially to both.

36. Apparatus according to claim 35 in which the freeze exchanger is of the shell and tube type and the tubes are vertical.

* * * * *